US005453750A

United States Patent [19]

Battista et al.

[11] Patent Number: 5,453,750

[45] Date of Patent: Sep. 26, 1995

[54] COAXIAL MICROSTRIP-TO-MICROSTRIP INTERCONNECTION SYSTEM

[75] Inventors: Daniel M. Battista, Marina Del Rey; Clifton Quan, Arcadia; Keith Whaley, Los Angeles; Bruce F. Wolfe, El Segundo, all of Calif.; Brian D. Young, Austin, Tex.

[73] Assignee: Hughes Aircraft Company, Los Angeles, Calif.

[21] Appl. No.: 173,438

[22] Filed: Dec. 23, 1993

[51] Int. Cl.[6] ..... H01P 5/00

[52] U.S. Cl. ..... 342/175; 434/578; 434/581; 434/63; 333/260; 333/238

[58] Field of Search ..... 439/578, 581, 439/63; 333/260, 238; 342/175

[56] References Cited

U.S. PATENT DOCUMENTS

| | | | |
|---|---|---|---|
| 4,487,999 | 12/1984 | Baird et al. | 174/52 |
| 4,724,409 | 2/1988 | Lehman | 333/260 |
| 4,810,981 | 3/1989 | Herstein | 333/27 |
| 4,957,456 | 9/1990 | Olson et al. | 439/578 |
| 4,975,065 | 12/1990 | Rosenberg et al. | 439/63 |
| 5,133,676 | 7/1992 | Hutchison et al. | 439/581 |
| 5,150,088 | 9/1992 | Virga et al. | 333/238 |

FOREIGN PATENT DOCUMENTS

| | | |
|---|---|---|
| 63-129701 | 6/1988 | Japan . |
| 4-51704 | 2/1992 | Japan . |

OTHER PUBLICATIONS

"Microwave Transmission Design Data," Sperry Gyioscope Company, Great Neck, Long Island , N.Y., pp. 2–3, 1954.

*Primary Examiner*—Mark Hellner

*Attorney, Agent, or Firm*—Leonard A. Alkov; W. K. Denson-Low

[57] ABSTRACT

A multistage transmission line interconnect device (50) for joining two microstrip circuits (82, 86). A center conductor pin (52) extends through a cylindrical dielectric (54) to form a coaxial midsection of the device. The ends of the pin extend from the dielectric to form a conductor for a straight open troughline at each end of the device. The ends of the pin are connected to the microstrip circuits by ribbon bonds (80, 84). Because the midsection of the device is coaxial, the microstrip circuits (82, 86) may be oriented at arbitrary angles with respect to one another.

12 Claims, 2 Drawing Sheets

COAXIAL MICROSTRIP-TO-MICROSTRIP INTERCONNECTION SYSTEM

TECHNICAL FIELD

The invention relates to microwave circuitry, and more particularly to transmission line interconnects for joining two microstrip circuits which reside in separate housings.

BACKGROUND OF THE INVENTION

Active antenna arrays typically employ a number of active transmit/receive (T/R) modules which must be coupled to the array radiating elements. Commonly assigned U.S. Pat. No. 4,957,456, "Self-Aligning Push-on Connector" illustrates one exemplary technique for connecting T/R modules to radiating elements. This interconnect device joins suspended stripline in the radiator to a T/R module with a coaxial input/output port. It is not suitable for connecting a T/R module and radiator with microstrip input/output ports.

SUMMARY OF THE INVENTION

An interconnection system is described for electrically connecting first and second microstrip circuits located within first and second housings and wherein the angular orientation of the housings is arbitrary. The first microstrip circuit comprises a first substrate and first microstrip conductor, The first housing comprises a first conductive housing member defining a first hole formed therein through a first housing surface and a first trough disposed between the hole and the first circuit. The second microstrip circuit comprises a second substrate and second microstrip conductor. The second housing comprises a second conductive housing member defining a second hole formed therein through a second housing surface to a second trough disposed between the second hole and the second circuit.

A center conductor pin is inserted through a dielectric spacer, wherein the spacer length is shorter than the pin length. A first end of the spacer is disposed within the first hole, and a second end of the spacer is disposed within the second hole. A first end portion of the pin extends from the spacer in the first trough to form a first troughline comprising the first end portion and the first trough. A second end portion of the pin extends from the spacer in the second trough to form a second trough line comprising the second end portion and the trough. Ribbon bonds electrically connect the respective ends of the pins to the first and second microstrip conductors. The angle between the first and second substrates is arbitrary, due to the circular symmetry of the center coaxial region defined by the dielectric spacer and center pin.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

The invention is a small multistage transmission line interconnect for joining microstrip circuits which reside in separate housings. Since the fields at the mid-section of the transmission line are cylindrically symmetrical, the interconnect provides an ideal means of connecting microstrip lines whose fields may be rotated at an arbitrary angle with respect to one another.

FIGS. 1–4 illustrate an exemplary embodiment of a coaxial transition device 50 in accordance with the invention used to connect an RF port of a Low Temperature Co-fired Ceramic (LTCC) T/R module 68 to a radiator circuit 60. The LTCC process involves printing all wiring patterns on the respective ceramic layers and then laminating these ceramic layers, all while the ceramic is in a "green" state. Then the laminated layers are heated to cure the ceramic material comprising the layers. After the ceramic has been cured, the active devices are installed, and an assembly cover is secured. LTCC microwave assemblies are described, for example, in commonly assigned U.S. Pat. Nos. 4,899,118 and 5,150,088.

Figure 1:
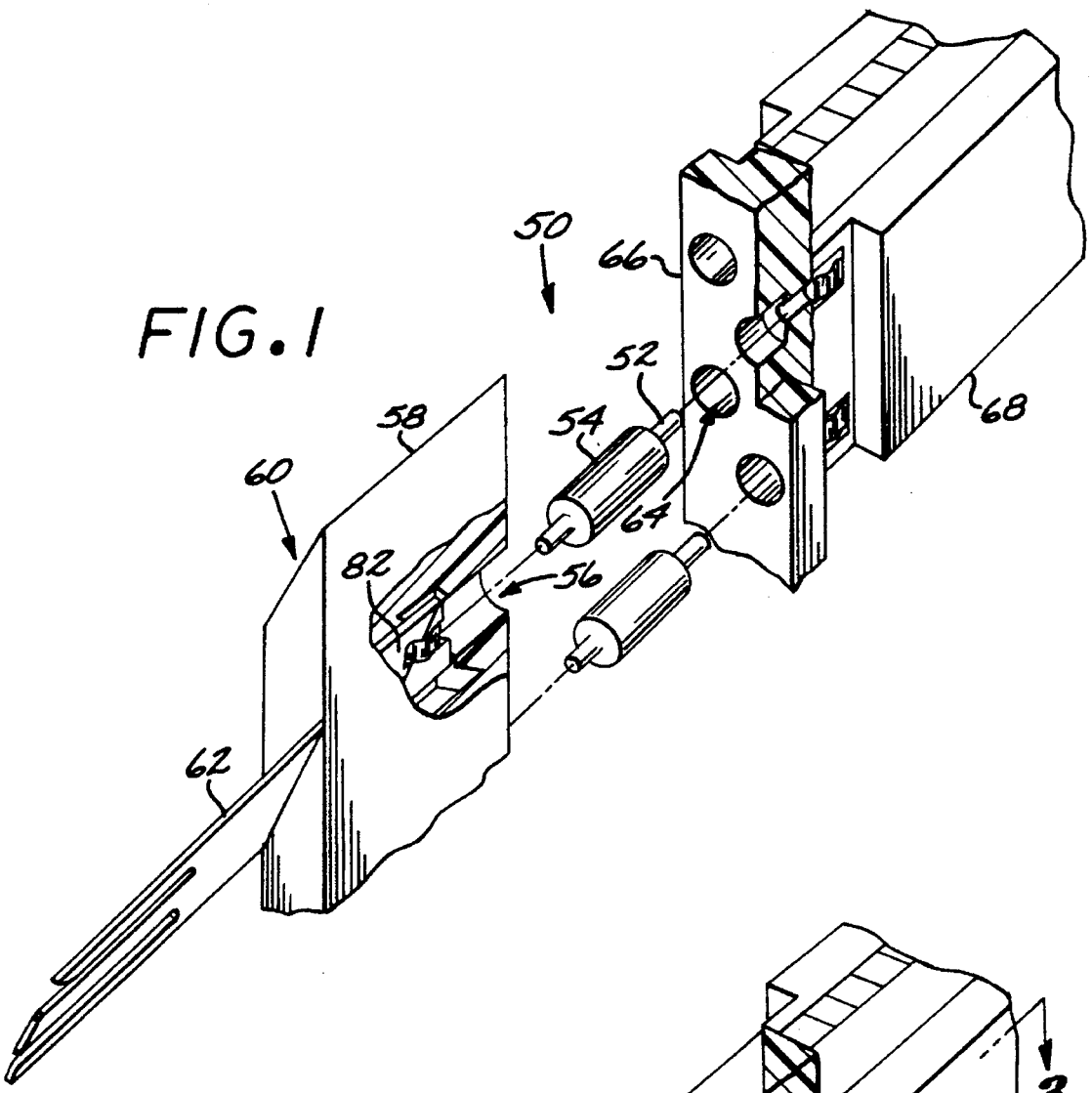
FIG. 1 is an exploded, partially broken-away view of a microwave circuit assembly embodying the invention, comprising interconnection between a radiator and an LTCC T/R module.
Figure 2:
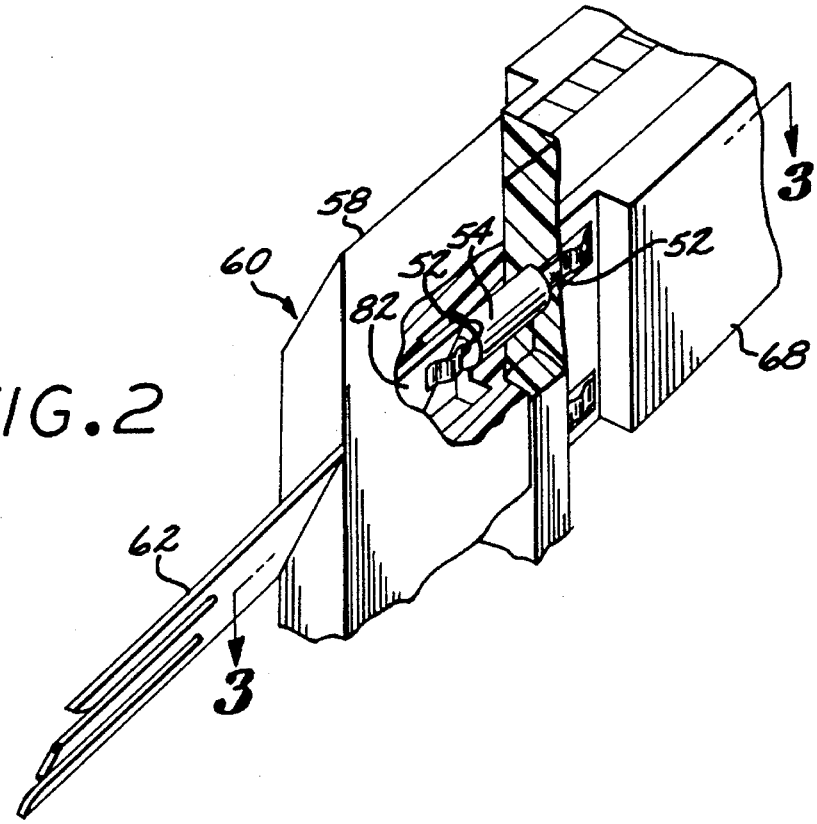
FIG. 2 is an isometric, partially broken-away view of the microwave circuit assembly of FIG. 1, shown in an assembled configuration.

FIG. 1 is an exploded view, showing the interconnect 50, radiator element 60 and T/R module 68 in an arrangement wherein the respective elements have not been assembled together. In this exemplary embodiment, a plurality of radiating elements may be connected to a corresponding plurality of T/R modules. In FIGS. 1 and 2 only one radiating element and one T/R module are shown. FIG. 2 is an isometric, partially broken-away view, showing the radiator 60 and the T/R module 68 in assembled form, interconnected by the interconnect device 50. The device 50 includes an 0.035 inch diameter copper alloy center conductor 52 which is pressed into an opening formed in a 0.110 diameter "Teflon" dielectric element 54. These dimensions are particularly selected for operation at X-band frequencies (8–12 GHz), but will also provide satisfactory performance at frequencies below 8 GHz and in the Ku band (12–18 GHz). One end of the dielectric member 54 is pressed into an untapered hole 56 defined in one housing 58 for the microstrip radiator circuitry 60 from which the radiator 62 extends. The opposite end of the dielectric member 54 fits into a tapered hole 64 in the housing 66 to which the T/R module 68 is secured. The taper of hole 64 allows for radial float, e.g., 0.10 inches, to take up assembly tolerances between the two housings 58 and 66.

Figure 3:
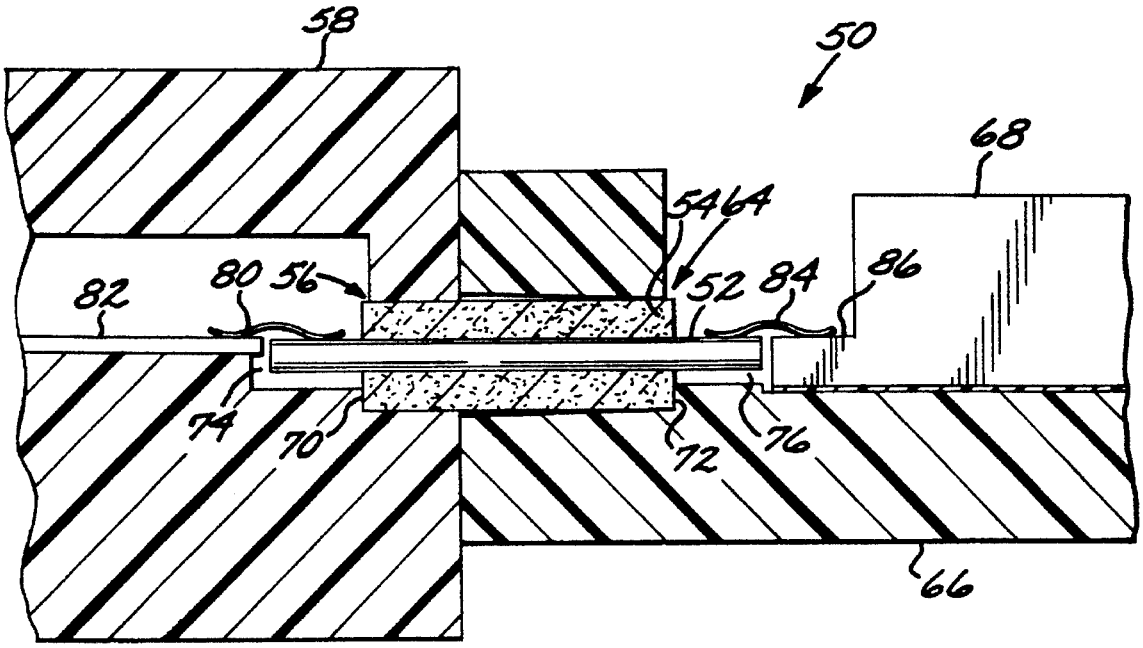
FIG. 3 is a cross-sectional view of the assembly as in FIG. 2, taken along line 3—3 of FIG. 2.

When the housings 58 and 66 are clamped together in an assembled condition, e.g., by fasteners such as screws, the dielectric/pin assembly (comprising pin 52 and dielectric 54) is restrained from motion along its longitudinal axis by a lip at the bottom of each hole. The lip at each hole is shown in FIG. 3. Lip 70 is defined in housing 58 at the end of hole 56. Lip 72 is defined in housing 66 at the end of hole 64. The inner conductive surfaces of the two holes act as electrical ground, eliminating the need for separate shells for that purpose.

At both ends, the center conductor 52 protrudes from the dielectric 54 and is partially surrounded by a trough, i.e., a half-hole, defined in the respective housing 58 and 66 in an open troughline configuration. Thus, troughline transmission lines are formed in the regions of the troughs. Troughline transmission lines are described, e.g., in co-pending, commonly assigned application Ser. No. 07/785,716, filed Oct. 31, 1991, "Coaxial to Microstrip Transition," by C. Holter and R. Allison, and in co-pending, commonly assigned application Ser. No. 07/415,003, "Coaxial-To-Microstrip Orthogonal Launchers," by C. Quan, the entire contents of which applications are incorporated herein by this reference. The RF field of the troughline matches that of the microstrip at both ends. Thus, trough 74 is defined in housing 58, and trough 76 is defined in housing 68. The trough diameter is approximately 0.080 to 0.090 inches in this example. The diameter of the troughs 74 and 76 and the diameter of the center conductor pin 52 are selected to provide a troughline characteristic impedance of 50 ohms, to match the characteristic impedance of the microstrip circuitry to which the troughline is connected. The coaxial center section of the center conductor 52 and dielectric 54 also have a characteristic impedance of 50 ohms, due to appropriate selection of the respective diameters. As a result, the respective characteristic impedances are matched.

A gold ribbon bond connects the center conductor pin 52 to the microstrip circuits at both ends. The pin 52 is gold plated to facilitate the ribbon bonding process. Thus, ribbon bond 80 provides a connection between the center conductor pin 52 and the conductor of microstrip radiator circuity 82. Ribbon bond 84 provides a connection between the pin 52 and the microstrip conductor at microstrip RF port 86 of the T/R module 68.

Figure 4:
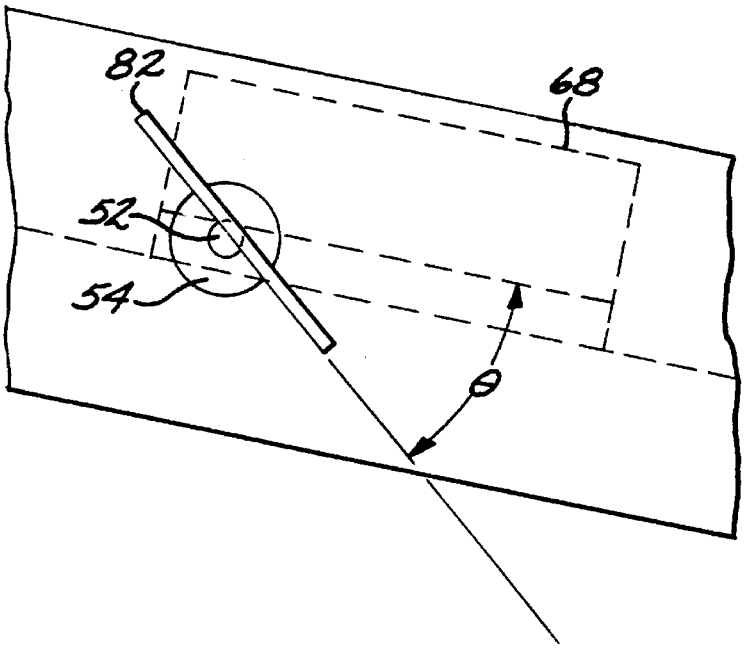
FIG. 4 is an end view of the assembly of FIG. 2, showing the arbitrary angle between the radiator microstrip assembly and the module.

FIG. 4 illustrates the arbitrary angular orientation between the microstrip circuity of the radiator and the T/R module. Here, the angle θ, the angle between the radiator circuitry 82 and the T/R module 68, is arbitrary.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An interconnection system for electrically connecting first and second microstrip circuits located within first and second housings and wherein the angular orientation of said first and second microstrip circuits is arbitrary, comprising:

said first microstrip circuit disposed within said first housing, said first circuit comprising a first substrate and first microstrip conductor, said first housing comprising a first housing member defining a first hole formed therein though a first housing surface and a first trough disposed between said hole and said first circuit, and wherein surfaces of said first housing defining said first hole and said first trough are electrically conductive;

said second microstrip circuit disposed within said second housing, said second circuit comprising a second substrate and second microstrip conductor, said second housing comprising a second housing member defining a second hole formed therein through a second housing surface to a second trough disposed between said second hole and said second circuit, and wherein surfaces of said second housing defining said second hole and said second trough are electrically conductive;

a collinear multistage transmission line interconnect circuit for electrically connecting said first and second microstrip circuits, said interconnect circuit including a mid-section line having circularly symmetrical electric fields, said interconnect circuit comprising:

a center conductor pin;

a dielectric spacer having an opening therethrough, said pin being disposed through said opening, a first end of said spacer disposed within said first hole, and a second end of said spacer disposed within said second hole, thereby forming a coaxial line section defining said mid-section line;

wherein a first end portion of said pin extends from said spacer in said first trough to form a first troughline transmission line comprising said first end portion and said first trough, and a second end portion of said pin extends from said spacer in said second trough to form a second troughline transmission line comprising said second end portion and said second trough, wherein said first and second troughline transmission lines and said coaxial mid-section transmission line are collinear;

first connecting means for electrically connecting a first end of said pin to said first microstrip conductor; and second connecting means for electrically connecting a second end of said pin to said second microstrip conductor, wherein an angular relationship between said first and second microstrip circuits is arbitrary.

2. The system of claim 1 wherein said first connecting means comprises a first length of electrically conductive ribbon bonded to said first end of said pin and to said first microstrip conductor, and said second connecting means comprises a second length of electrically conductive ribbon bonded to said second end of said pin and to said second microstrip conductor.

3. The system of claim 1 wherein said first hole is tapered so as to provide radial float to take up assembly tolerances between said first and second housings.

4. The system of claim 1 further comprising means for restraining longitudinal motion of said dielectric spacer along a longitudinal axis thereof when said first and second housings are secured together.

5. The system of claim 4 wherein said restraining means comprises first and second lip surfaces formed at respective bottoms of said first and second holes.

6. The system of claim 1 wherein said center conductor and said spacer define a center coaxial transmission line section extending within said first and second holes and having a coaxial line characteristic impedance, said first and second troughlines have respective troughline characteristic impedances, and said first and second microstrip circuits have respective microstrip characteristic impedances, and wherein said coaxial line section, said first and second troughlines and said first and second microstrip circuits are arranged so that said respective characteristic impedances are substantially equal.

7. An active radar system, comprising:

a radiating element, comprising a radiator circuitry housing, a radiator and radiator microstrip circuit contained within said housing for connection to said radiating element, said microstrip circuit comprising a first substrate and a first microstrip conductor defined thereon;

a transmit/receive module, comprising a module housing and a module microstrip circuit with an input/output (I/O) port, said module microstrip circuit comprising a second substrate and a second microstrip conductor defined thereon; and an interconnection system for electrically connecting said radiator microstrip circuit and said module I/O port, said interconnection system including a mid-section transmission line having circularly symmetrical electric fields to permit an arbitrary angular orientation of said radiator microstrip circuit and said module microstrip circuit, said interconnection system comprising:

a first hole formed in said radiator circuitry housing though a first housing surface, and a first trough defined in said radiator circuitry housing and disposed between said first hole and said radiator microstrip circuit, and wherein surfaces of said radiator circuitry housing defining said first hole and said first trough are electrically conductive;

a second hole formed in said module housing through a second housing surface to a second trough defined in said module housing and disposed between said second hole and said second circuit, and wherein surfaces of said T/R module housing defining said second hole and said second trough are electrically conductive;

a center conductor pin having a pin length;

a dielectric spacer having an opening therethrough and a spacer length, wherein said spacer length is shorter than said pin length, said pin is disposed through said opening, a first end of said spacer is disposed within said first hole, and a second end of said spacer is disposed within said second hole, thereby forming a coaxial line section defining said mid-section transmission line having circularly symmetrical electric fields;

wherein a first end portion of said pin extends from said spacer in said first trough to form a first troughline transmission line comprising said first end portion and said first trough, and a second end portion of said pin extends from said spacer in said second trough to form a second troughline transmission line comprising said second end portion and said second trough, and wherein said mid-section transmission line and said first and second troughline transmission lines are collinear;

first connecting means for electrically connecting a first end of said pin to said first microstrip conductor; and second connecting means for electrically connecting a second end of said pin to said second microstrip conductor.

8. The radar system of claim 7 wherein said first connecting means comprises a first length of electrically conductive ribbon bonded to said first end of said pin and to said first microstrip conductor, and said second connecting means comprises a second length of electrically conductive ribbon bonded to said second end of said pin and to said second microstrip conductor.

9. The radar system of claim 7 wherein said first hole is tapered so as to provide radial float to take up assembly tolerances between said first and second housings.

10. The system of claim 7 further comprising means for restraining longitudinal motion of said dielectric spacer along a longitudinal axis thereof when said radiator circuitry and said T/R module housings are secured together.

11. The system of claim 7 wherein said restraining means comprises first and second lip surfaces formed at respective bottoms of said first and second holes.

12. The system of claim 7 wherein said center conductor and said spacer define a center coaxial transmission line section extending within said first and second holes and having a coaxial line characteristic impedance, said first and second troughlines have respective troughline characteristic impedances, and said first and second microstrip circuits have respective microstrip characteristic impedances, and wherein said coaxial line section, said first and second troughlines and said first and second microstrip circuits are arranged so that said respective characteristic impedances are substantially equal.

* * * * *